US007064710B1

(12) United States Patent
Ksienski et al.

(10) Patent No.: US 7,064,710 B1
(45) Date of Patent: Jun. 20, 2006

(54) MULTIPLE BEAM STEERED SUBARRAYS ANTENNA SYSTEM

(75) Inventors: David A. Ksienski, Los Angeles, CA (US); James P. McKay, Hermosa Beach, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 11/058,116

(22) Filed: Feb. 15, 2005

(51) Int. Cl.
*H01Q 3/24* (2006.01)

(52) U.S. Cl. ..... 342/372; 342/373

(58) Field of Classification Search ..... 342/81, 342/154, 371, 372, 373, 374
See application file for complete search history.

(56) References Cited

U.S. PATENT DOCUMENTS 3,999,182 A * 12/1976 Moeller et al. ..... 342/372
4,045,800 A * 8/1977 Tang et al. ..... 342/372
4,388,626 A * 6/1983 Gans ..... 342/373
4,410,894 A * 10/1983 Gans et al. ..... 342/368
4,451,831 A * 5/1984 Stangel et al. ..... 342/374
4,532,517 A * 7/1985 LaBerge et al. ..... 342/372
5,734,349 A * 3/1998 Lenormand et al. ..... 342/373
5,990,830 A * 11/1999 Vail et al. ..... 342/368
6,175,326 B1 * 1/2001 Kare ..... 342/25 R
2004/0043795 A1 * 3/2004 Zancewicz ..... 455/562.1

* cited by examiner

*Primary Examiner*—Dao L. Phan
(74) *Attorney, Agent, or Firm*—Derrick Michael Reid

(57) ABSTRACT

A phased array antenna system divides the array into a plurality of subarrays that are driven by fine phase shifters with each subarray having a plurality of antenna elements driven by respective coarse phase shifters that are preferably MEMS coarse phase shifters having low weight and low cost and are infrequently used for improved reliability for selecting a coarse beam coverage area while the fine phase shifters are used to scan a high-gain antenna pattern within the selected coarse beam coverage area. Two-bit MEMS phase shifters are used to scan the beams from subarrays to various coverage areas within the required antenna field of view, thereby providing coarse beam steering for an array.

7 Claims, 4 Drawing Sheets

VIRTUAL ELEMENT SUBARRAY
PHASED ARRAY ANTENNA SYSTEM

VIRTUAL ELEMENT SUBARRAY
PHASED ARRAY ANTENNA SYSTEM

VIRTUAL ELEMENT SUBARRAY PHASED ARRAY ANTENNA

13 BEAMS VIRTUAL ELEMENT SUBARRAY PATTERN

SUBARRAY PHASE SHIFTER SETTINGS
FOR STEERED POSITIONS

MULTIPLE BEAM STEERED SUBARRAYS ANTENNA SYSTEM

STATEMENT OF GOVERNMENT INTEREST

The invention was made with Government support under contract No. FA8802-04-C-0001 by the Department of the Air Force. The Government has certain rights in the invention.

FIELD OF THE INVENTION

The invention relates to the field of antenna systems. More particularly the present invention relates to steered subarrays for multiple beam array antenna communication systems.

BACKGROUND OF THE INVENTION

The conventional phased array antenna systems utilize one discrete Gallium Arsenide field effect transistor (GaAs FET) phase shifter and a respective amplifier or transmit and receive transceiver for each respective radiating antenna element. The amplifiers are respectively positioned between the respective phase shifters and the respective antenna elements. The phase shifters are used for beam steering. However, conventional discrete FET phase shifters used for antenna beam steering are costly and have undesirable high insertion loss, especially at high frequencies. Very large arrays require a large number of amplifiers to compensate for this high insertion loss. A large number of amplifier leads to high cost and power requirements for the antenna system.

Alternatively, the GaAsFET phase shifters can be replaced with microelectromechanical systems (MEMS) phase shifters, which are positioned between the respective amplifier or transceiver module and the respective radiating antenna element. The use of MEMS phase shifters can lead to mass and cost reductions, but due to limitations on the number of MEMS phase shifter changes over operational lifetimes does not permit the rapid beam scanning and flexibility normally required of a multiple beam array. The MEMS phase shifters are mechanical devices that have a high failure rate with a low operational lifetime expectancy but are low cost and low weight.

Phased array antenna systems have used subarrays where a plurality of subarrays are individually steered where a coarse scan phase shifter is used in combination with a plurality of fine scan phase shifters. The beam steering is accomplished by a coarse scan for selecting a predetermined coarse area and then by a fine scan for selecting a fine scan beam spot within the coarse area. In a first configuration, a coarse scan GaAsFET phase shifter drives an amplifier that then drives a plurality of fine scan discrete GaAsFET phase shifters driving respective antenna elements. The first configuration suffers from insertion losses but provides flexible fine and coarse beam steering. In a second configuration, a coarse scan GaAsFET phase shifter drives an amplifier that then drives a plurality of MEMS phase shifters driving a plurality of antenna elements. The second configuration suffers from a limited number of scans because the fine scans are adjusted often relative to the number of times the coarser scans are adjusted, leading to premature failure of the MEMS phase shifters. These and other disadvantages are solved or reduced using the invention.

SUMMARY OF THE INVENTION

An object of the invention is to provide a phased array antenna system having improved reliability.

Another object of the invention is to provide a phased array antenna system having coarse scan phase shifters directly driving antenna elements.

Yet another object of the invention is to provide a phased array antenna system having coarse scan phase shifters directly driving antenna elements and having a fine scan phase shifter.

Still another object of the invention is to provide a phased array antenna system having coarse scan microelectromechanical systems (MEMS) phase shifters directly driving antenna elements and having a fine scan phase shifter.

A further object of the invention is to provide a phased array antenna system having coarse scan microelectromechanical systems (MEMS) phase shifters that phase shift infrequently directly driving antenna elements for selecting a coarse area and having a fine scan phase shifter frequently adjusting the beam stop within the coarse area.

The invention is directed to a phased array antenna system where a fine phase shifter drives an amplifier that drives a plurality of coarse phase shifters that drive respective antenna elements. The coarse phase shifters that operate infrequently are preferably MEMS phase shifters. The MEMS phase shifters are placed between the amplifiers or transmit and receiver transceivers and the radiating antenna elements in order to provide coarse beam steering to a selected coarse area of the required coverage area. Preferably, conventional GaAsFET fine phase shifters are used for fine beam steering within the coarse area. By using a plurality of MEMS coarse phase shifters, the system has reduced mass and cost with high reliability by virtue of infrequent usage of the coarse beam steering. The system enables rapid and flexible beam fine and coarse scanning using MEMS coarse phase shifters that have low insertion losses having longer switching lifetime. The system partitions beam scanning into infrequently used MEMS phase shifters and frequently used conventional phase shifters for providing coarse and fine beam pointing with a reduction of the high-loss conventional phase shifters. The system can provide increased antenna gain by 5 dB, with no accompanying increase in battery power or mass. The system also has improved antenna resolution. These and other advantages will become more apparent from the following detailed description of the preferred embodiment.

DETAILED DESCRIPTION OF THE PREFERRED EMBODIMENT

Figure 1A:
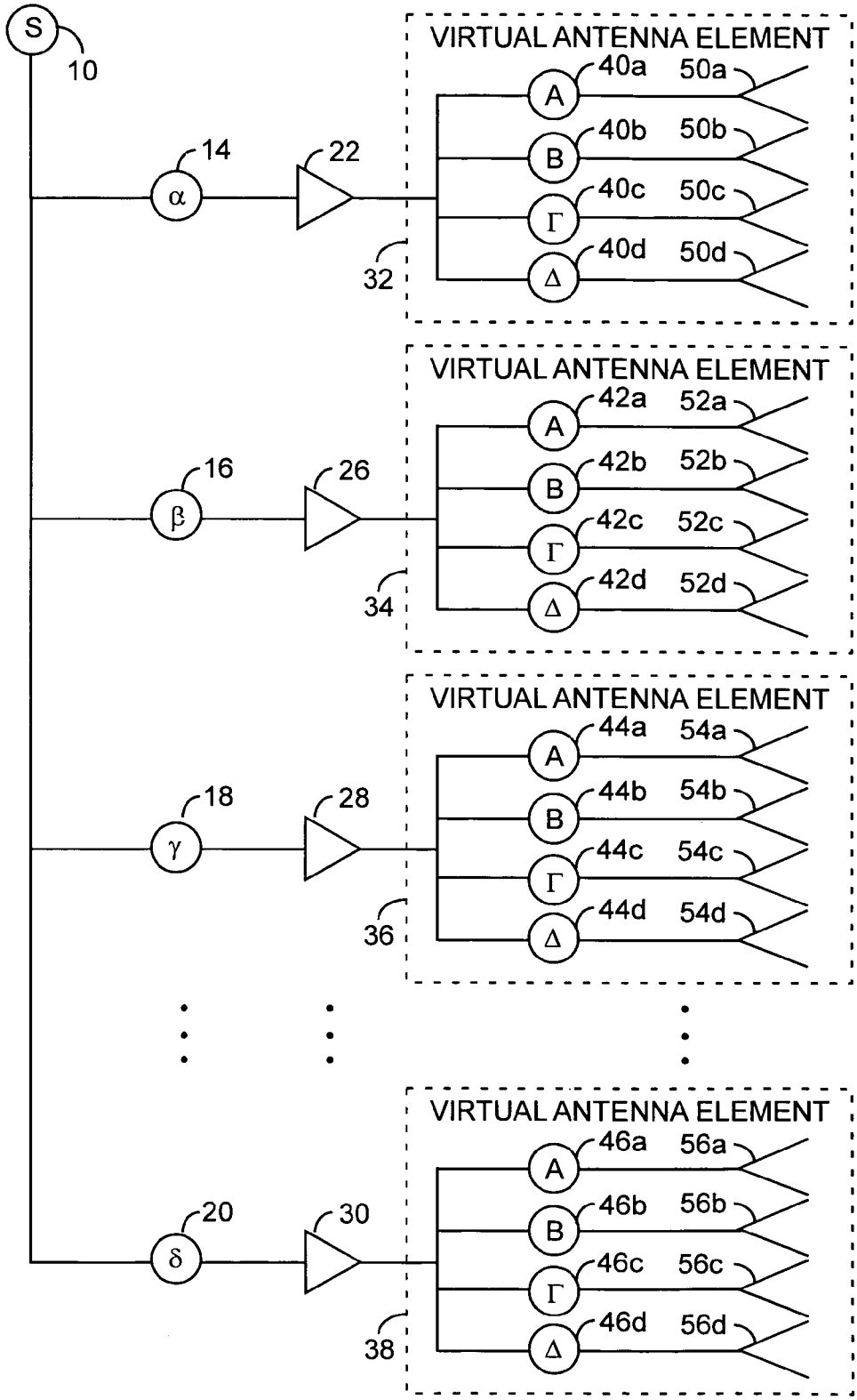
FIG. 1A is schematic of a virtual element subarray phased array antenna system.

An embodiment of the invention is described with reference to the figures using reference designations as shown in the figures. Referring to FIG. 1A, a phase array antenna system transmits or receives a signal S. During transmission, the signal S is routed to four fine phase shifters 14, 16, 18, and 20 providing respective phase shifts α, β, γ, and δ, respectively. Each of the fine phase shifters 14, 16, 18, and 20 communicate the transmit signal 10 to amplifiers 22, 26, 28, and 30, that communicate an amplified and phase shifted signal respective to four virtual antenna elements 32, 34, 36 and 38. Each of the virtual antenna elements 32, 34, 36 and 38 include four coarse phase shifters, 40*a*, 40*b*, 40*c*, and 40*d*, and 42*a*, 42*b*, 42*c*, and 42*d*, and 44*a*, 44*b*, 44*c*, and 44*d*, and 46*a*, 46*b*, 46*c*, and 46*d*, respectively, and respective antenna elements 50*a*, 50*b*, 50*c*, and 50*d*, and 52*a*, 52*b*, 52*c*, and 52*d*, and 54*a*, 54*b*, 54*c*, and 54*d*, and 56*a*, 56*b*, 56*c*, and 56*d*, respectively. The coarse phase shifters are preferably MEMS phase shifters. While only four elements are shown for convenience, any number of virtual antenna elements can be grouped together within a phased array antenna system. Each virtual antenna element includes a set of antenna elements, such as four antenna elements, having respective coarse phase shifts, such as phase shifts A, B, Γ, and Δ.

Figure 1B:
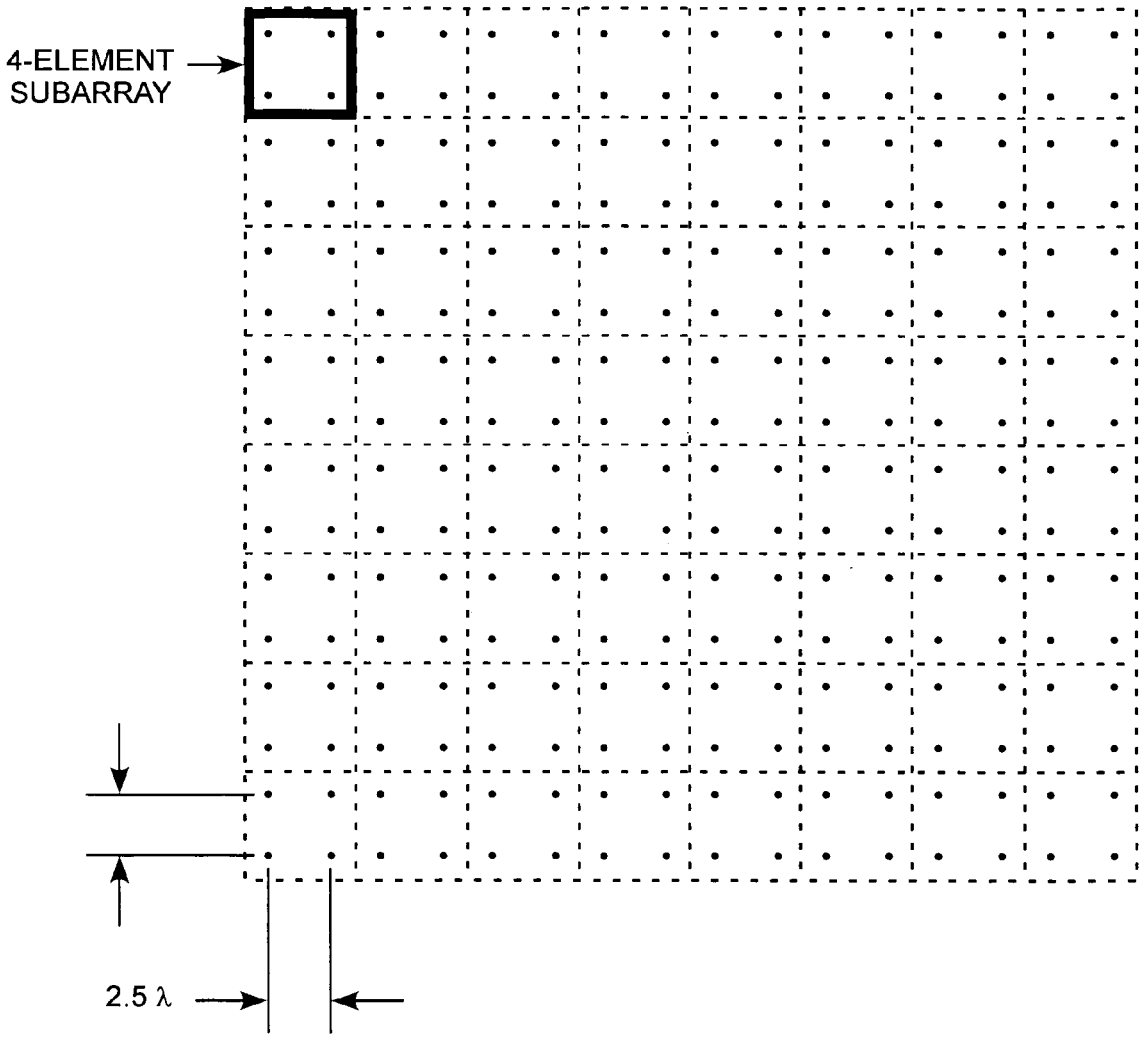
FIG. 1B is a drawing of a virtual element subarray phased array antenna system.

Referring to FIGS. 1A and 1B, the antenna system utilizes groups of antenna elements as subarrays, referred to as a virtual antenna element, in order to produce scanned beam patterns. The coarse beam steering is achieved using low-cost, light-weight MEMS phase shifters 40*a*, 40*b*, 40*c*, and 40*d*, and 42*a*, 42*b*, 42*c*, and 42*d*, and 44*a*, 44*b*, 44*c*, and 44*d*, and 46*a*, 46*b*, 46*c*, and 46*d*. Fine beam steering is achieved using conventional GaAsFET phase shifters 14, 16, 18, and 20. Hence, the antenna system provides separate control for coarse and fine beam steering using multiple simultaneous high-gain beams enabling scanning within a coarse coverage area. The MEMS phase shifters can be used to coarse scan the beam from a satellite array toward a coverage area of the earth, and the conventional GaAsFET phase shifters are used to fine scan the steered beam within the coverage area of the earth.

Figure 2:
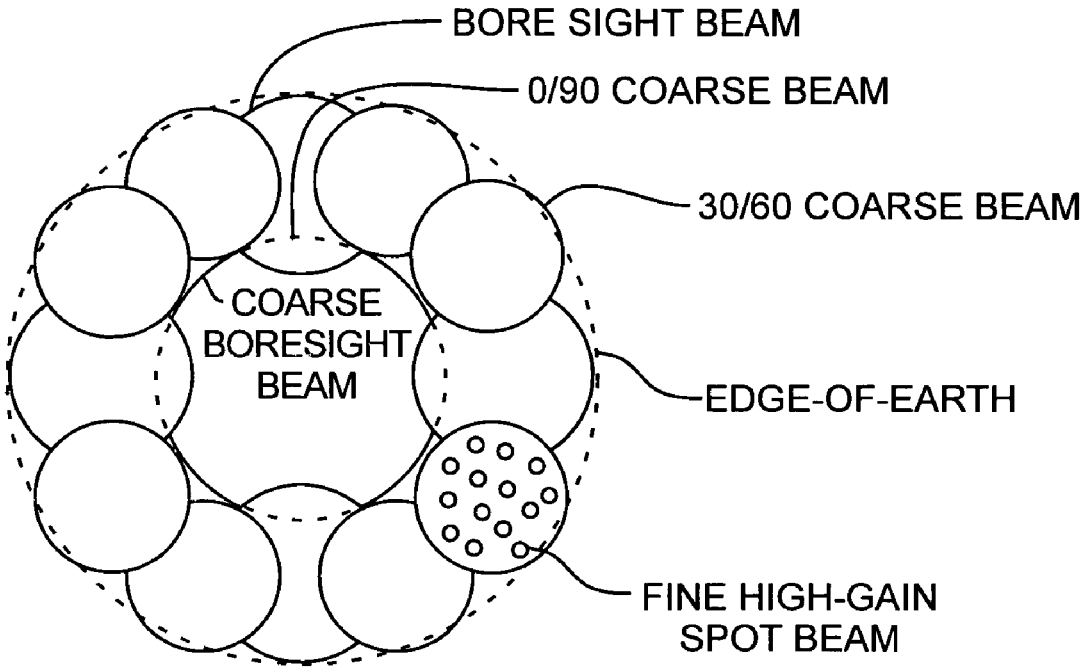
FIG. 2 is a diagram of a 13-beam virtual element subarray pattern.
Figure 3:
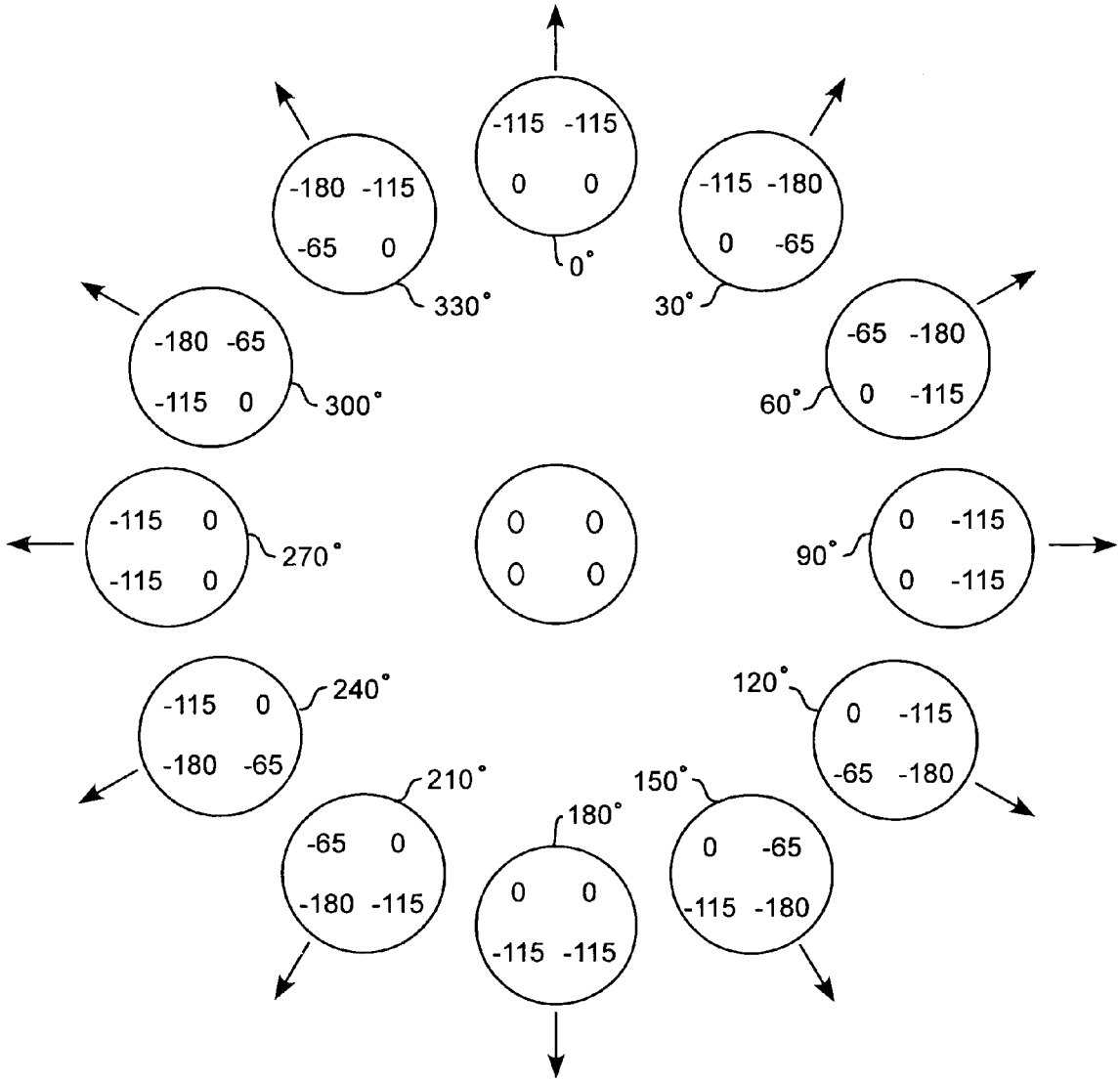
FIG. 3 is a diagram of subarray phase shifter settings for various beam steered positions.

Referring to all of the Figures, and more particularly to FIGS. 2 and 3, the overall layout of the array is divided into subarrays each having a predetermined number of elements, such that each subarray consists of four antenna elements having a peak gain of each element. The number of bits for each MEMS phase shifter can be selected to optimize performance for the particular application of interest. For exemplar earth coverage from a geosynchronous satellite, a two-dimensional planar array of 8×8 equispaced virtual elements can be employed with a typical 2.5λ wavelength spacing between elements, with each subarray having four elements and with each element having a typical peak gain of 18.2 dB. Preferably, either one-bit or two-bit MEMS phase shifters are employed for coarse beam scanning. When 1-bit MEMS phase shifters are used to steer the four-element subarrays, then two phase shifts, 0 and α, are available for producing beams for coarse steering.

An antenna pattern of a single element illuminating the entire earth may have a level of 18.2 dB peak directivity with a pattern rolloff of 2.0 dB at the edge of the earth to 16.2 dB directivity. Using the same radiating antenna element, the system can provide earth coverage at a level of 20.0 dB directivity with a 3.8 dB improvement using four principal-plane scanned beams with α=−110 degrees. Alternatively, when two-bit MEMS phase shifters are used, then four different phase shifts 0, $\alpha_1$, $\alpha_2$, and $\alpha_3$ can be used to produce nine beams with one boresight beam with four principal-plane scanned beams and with four diagonal-plane scanned beams for providing earth coverage at a level of 22.5 dB.

Preferably, each diagonal-plane beam is replaced with two off-diagonal-plane beams, so that the earth is covered using thirteen beams including a coarse boresight beam, four 0/90 coarse beams, and eight 30/60 coarse beam using the four angles A, B, Γ, and Δ, such. Beam steering of four-element subarrays using two-bit MEMS phase shifters generates thirteen beams using four different phase shifts of 0°, −65°, −115°, and −180°. Using this preferred thirteen coarse beam approach, earth coverage is at a level of 22.8 dB directivity. A boresight beam is produced by setting all of the phase shifters to zero degrees. The system produces a boresight beam with no degradation. The worst-case degradation in spot beam directivity due to the use of the MEMS subarrays is 2.0 dB and 0.1 dB respectively when one-bit and two-bit phase shifters are employed. The coarse phase shifting provides for the selection of any one of the thirteen coarse beams by adjusting the phase shifter in the virtual element subarrays. After setting the coarse phase shifts, the fine phase shifting can then be continually adjusted for fine spot beam scanning within the selected coarse beams. The high-gain spot beam scans the coarse beam by fine positioning of the phase array pattern within coarse beam disposed within the edge of earth. Differing number of virtual antenna patterns and number of coarse phase shifts can be used, such as, by selecting four coarse phase shifts angles for generating thirteen possible coarse beams each illuminating a respective coverage area. The fine phase shifting using angles α, β, γ, through δ, for each respective subarray can then be used to project and scan the high-gain spot beam within the coarse beam coverage area.

The invention is directed to phased array antenna system having a plurality of subarrays, that is, virtual antenna elements. Each subarray has a plurality of antenna elements driven by coarse phase shifters, that are preferably MEMS coarse phase shifters. Each subarray is driven by a fine phase shifter. Using a plurality of MEMS coarse phase shifters provides for cost and mass reductions provided with enhanced reliability through infrequent use. The system has potential uses in applications requiring large multiple-beam arrays such as satellite antenna arrays having a fixed number of elements. The system can provide increased antenna gain by 5.0 dB, with no accompanying increase in battery power or mass, and with decreased battery power and mass. The antenna system enables a reduction in the number of conventional GaAs FET phase shifters by a factor of (N−1)/N, where N is the number of elements per subarray for cost reduction. Because the MEMS phase shifters weigh less than conventional GaAs FET phase shifters, the use of the MEMS phase shifters provides mass reduction. Those skilled in the art can make enhancements, improvements, and modifications to the invention, and these enhancements, improvements, and modifications may nonetheless fall within the spirit and scope of the following claims.

What is claimed is:

1. An antenna system comprising, subarrays for projecting a spot beam, each of the subarrays comprise antenna elements, fine phase shifters for respectively driving the subarrays at the respective fine phase shifts, a plurality of sets of coarse phase shifters, each set of coarse phase shifters for respectively driving the antenna elements of a respective subarray, each of the fine phase shifters are coupled to a respective set of coarse phase shifters, the coarse phase shifters having phase shift angles for selecting one of a plurality of coarse coverage areas, the fine phase shifters for selecting one of a plurality of spot beams within the coarse coverage area.

2. The system of claim 1 further comprising, amplifiers respectively coupled between respective fine phase shifters and a respective set of coarse phase shifters.

3. The system of claim 1 wherein, each subarray comprises four antenna elements, each set of coarse phase shifters comprises four phase shifters, and the subarrays are 8×8 subarrays.

4. The system of claim 1 wherein, each subarray comprises four antenna elements, each set of coarse phase shifters comprises four phase shifters, and the subarrays are N×M subarrays.

5. The system of claim 1 each subarray comprises four antenna elements, each set of coarse phase shifters comprises four phase shifters, the subarrays are N×M subarrays, the four phase shifters having shift angles of 0°, −65°, −115°, and −180°, and the number of coverage areas is thirteen.

6. The system of claim 1 each subarray comprises four antenna elements, each set of coarse phase shifters comprises four phase shifters, the subarrays are N×M subarrays, the four phase shifters having shift angles of 0°, −65°, −115°, and −180°, the number of coverage areas is thirteen, and the number of spot beams is P spot beams.

7. The system of claim 1, wherein the coarse phase shifters are MEMS phase shifters.

* * * * *